US008136685B2

(12) United States Patent
Tombu

(10) Patent No.: US 8,136,685 B2
(45) Date of Patent: Mar. 20, 2012

(54) DEVICE FOR CLOSING A BARREL OR THE LIKE

(75) Inventor: Nicolas Tombu, Saintes (FR)

(73) Assignee: Tonnellerie Baron, Les Gonds (FR)

( * ) Notice: Subject to any disclaimer, the term of this patent is extended or adjusted under 35 U.S.C. 154(b) by 817 days.

(21) Appl. No.: 11/914,071

(22) PCT Filed: Jul. 5, 2005

(86) PCT No.: PCT/FR2005/050540

§ 371 (c)(1),
(2), (4) Date: Jul. 25, 2008

(87) PCT Pub. No.: WO2006/005884

PCT Pub. Date: Jan. 19, 2006

(65) Prior Publication Data

US 2009/0020505 A1 Jan. 22, 2009

(30) Foreign Application Priority Data

Jul. 8, 2004 (FR) ..... 04 07611

(51) Int. Cl.
*B65D 39/00* (2006.01)
*B65D 39/08* (2006.01)
*B01F 13/02* (2006.01)

(52) U.S. Cl. ..... 217/107; 217/110; 366/131; 366/228

(58) Field of Classification Search ..... 217/107, 217/110; 366/131, 231, 228
See application file for complete search history.

(56) References Cited

U.S. PATENT DOCUMENTS

| | | | | |
|---|---|---|---|---|
| 567,563 | A * | 9/1896 | Butterfield | 217/107 |
| 571,842 | A * | 11/1896 | Parbel | 217/107 |
| 1,939,934 | A * | 12/1933 | Wackman | 220/258.3 |
| 2,101,030 | A * | 12/1937 | Kunze | 220/235 |
| 2,156,540 | A * | 5/1939 | Melrath | 220/257.2 |
| 2,313,331 | A * | 3/1943 | Flynn | 251/297 |
| 2,397,500 | A | 4/1946 | Merker et al. | |
| 3,028,036 | A | 4/1962 | Goll | |
| 4,826,029 | A | 5/1989 | Skoglie et al. | |
| 2009/0020505 | A1 * | 1/2009 | Tombu | 217/107 |

FOREIGN PATENT DOCUMENTS

| | | |
|---|---|---|
| GB | 1 359 955 | 7/1974 |
| NL | 7 809 323 | 3/1980 |

* cited by examiner

*Primary Examiner* — Tony G SooHoo
(74) *Attorney, Agent, or Firm* — Young & Thompson

(57) ABSTRACT

A sealing device for a barrel or the like, the barrel including an opening (22) arranged especially at the level of at least one bottom (14), characterized in that it includes, on the one hand, an attachment ring (24) located on the periphery of the opening (22) at the level of the outer surface of the bottom (24), connected to the bottom by any suitable manner, and, on the other hand, a sealing device having a first part (30) that can be wedged at the level of the opening (22) and a second part (32) that can be screwed onto the ring (24), the second part (32) as it is being screwed tending to increase the force of the pressure between the first part (30) and the opening (22).

17 Claims, 5 Drawing Sheets

Figure 1:
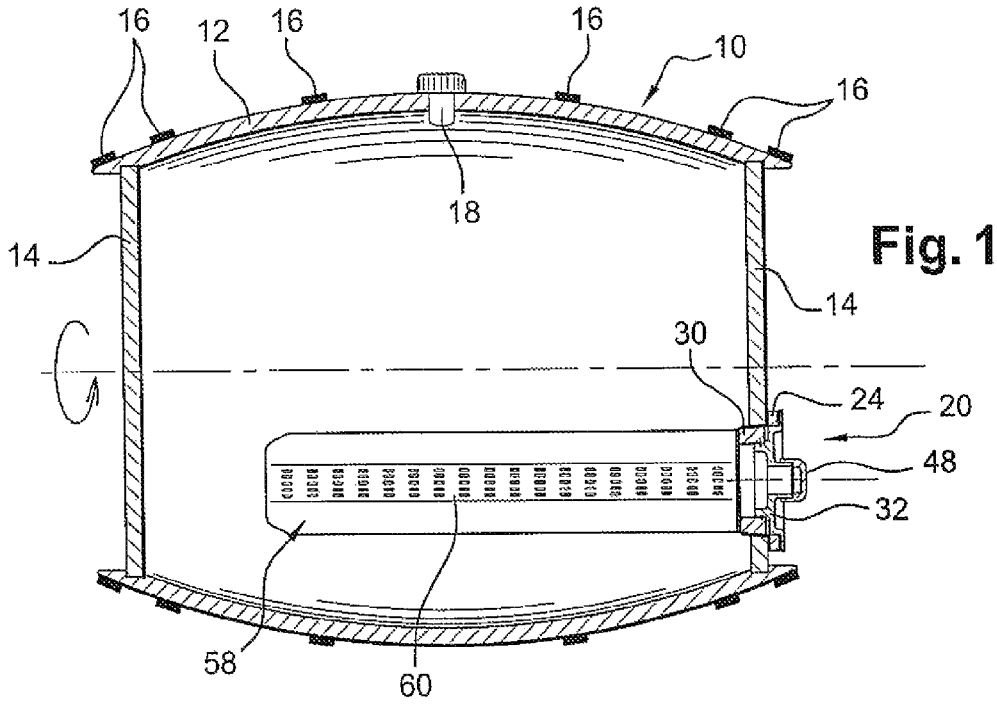

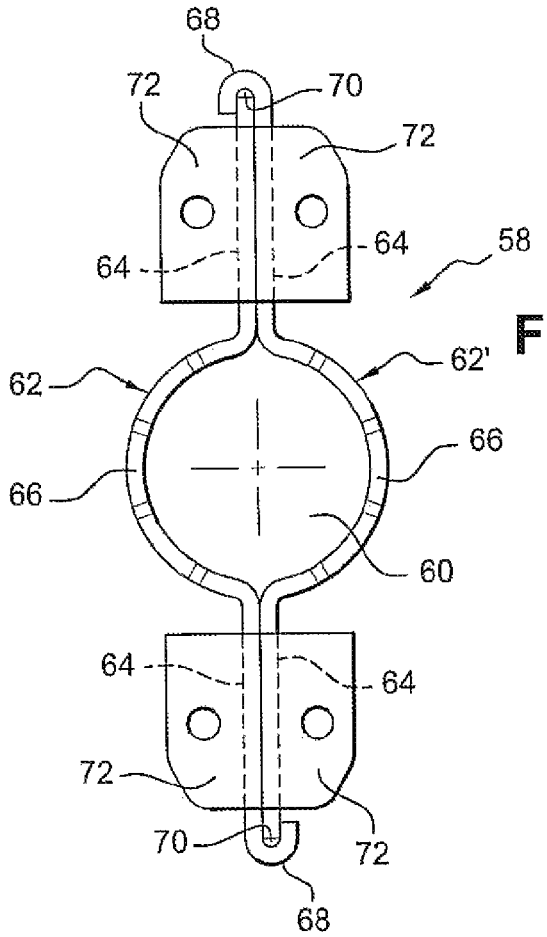
Fig. 7
Fig. 8
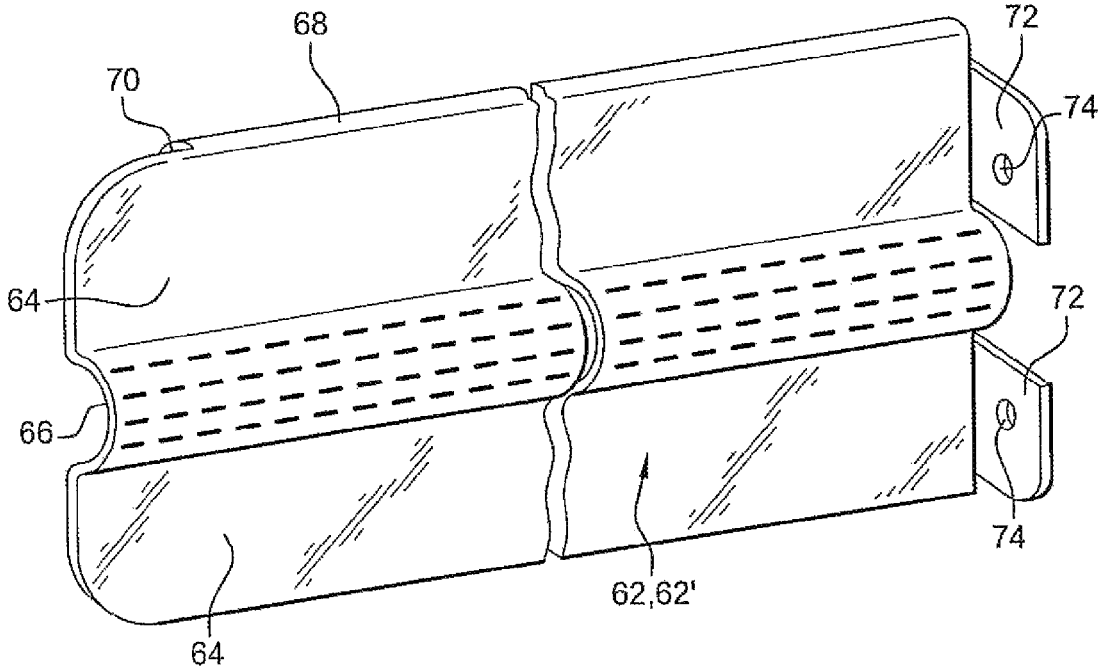

DEVICE FOR CLOSING A BARREL OR THE LIKE

This invention relates to a sealing device for a barrel or the like. This device is more especially suited to the wine-making method called "barrel wine-making" for which the fermentation phase is carried out in a barrel.

Below, a barrel is defined as any wooden container that is used especially for maturation of wine. According to one widely used embodiment, a barrel comprises a side wall composed of staves, closed on each end by bottoms. A barrel comprises at least one orifice, preferably two, roughly 3 to 5 cm in diameter, which can be sealed by a plug or the like.

In the case of barrel wine-making, the grapes must be introduced into the interior of the barrel for their fermentation. For this purpose, the bottom of the barrel includes a trap door with an opening above the orifice of a plug to facilitate introduction of the grapes. In addition, mixing elements in the form of arms are attached at the level of the interior wall of one bottom to support mixing of the grapes during the fermentation phase.

Even if the existing devices are satisfactory with regard to introducing and mixing the grapes, they are not entirely satisfactory because the barrels used for fermentation cannot be used to store the wine. Thus, it is necessary to provide one set of barrels for fermentation and another for storage.

Another approach consists in replacing the bottom that is provided with the trap door and mixing elements by a "classic" bottom between the fermentation and storage phases. Even if a large part of the barrel is thus preserved for fermentation and storage, it is sometimes necessary to provide two sets of barrel bottoms. Moreover, for this changing of the bottom, it is necessary to remove the hoops from the barrel, which is relatively long and costly.

This invention is also intended to remedy the drawbacks of existing devices by suggesting a new sealing device for a barrel that makes it possible to use the same barrel for the phases of fermentation and storage, ensuring excellent tightness and optionally allowing attachment of different accessories used during wine-making.

For this purpose, the object of the invention is a sealing device for a barrel or the like, said barrel comprising an opening arranged especially at the level of at least one bottom, characterized in that it comprises, on the one hand, an attachment ring located on the periphery of the opening at the level of the outer surface of the bottom, connected to the bottom by any suitable means, and, on the other hand, a sealing device comprising a first part that can be wedged at the level of the opening and a second part that can be screwed onto the ring, the second part as it is being screwed tending to increase the force of the pressure between the first part and the opening.

Figure 2:
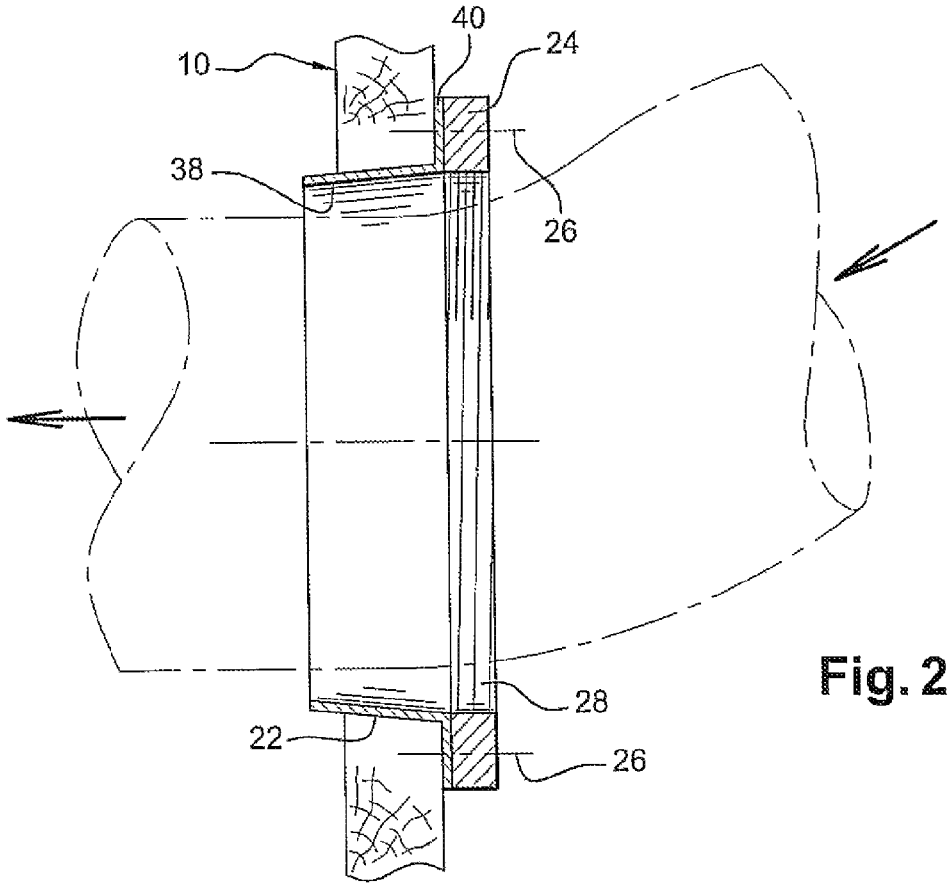
Figure 3:
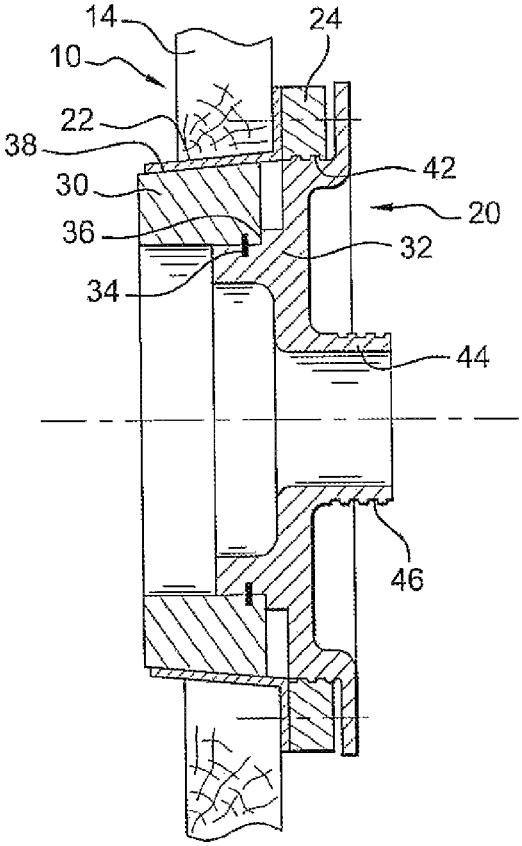
Figure 4:
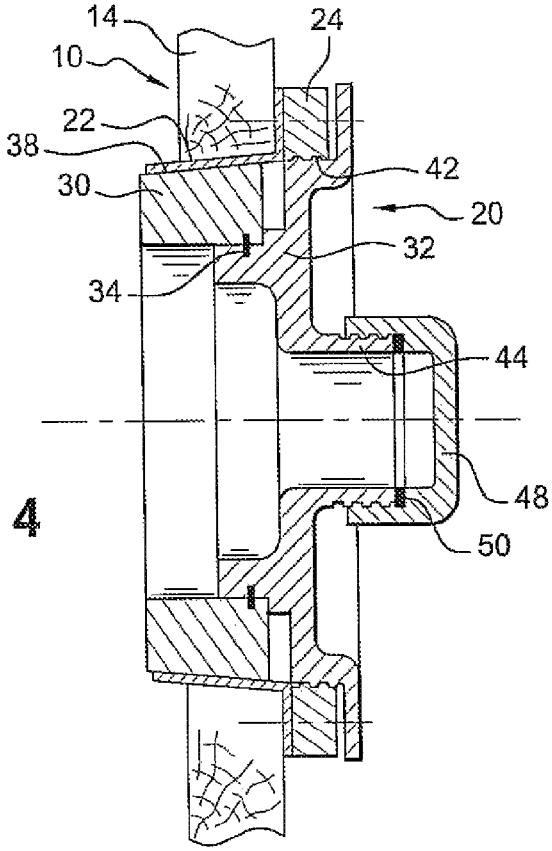
Figure 5:
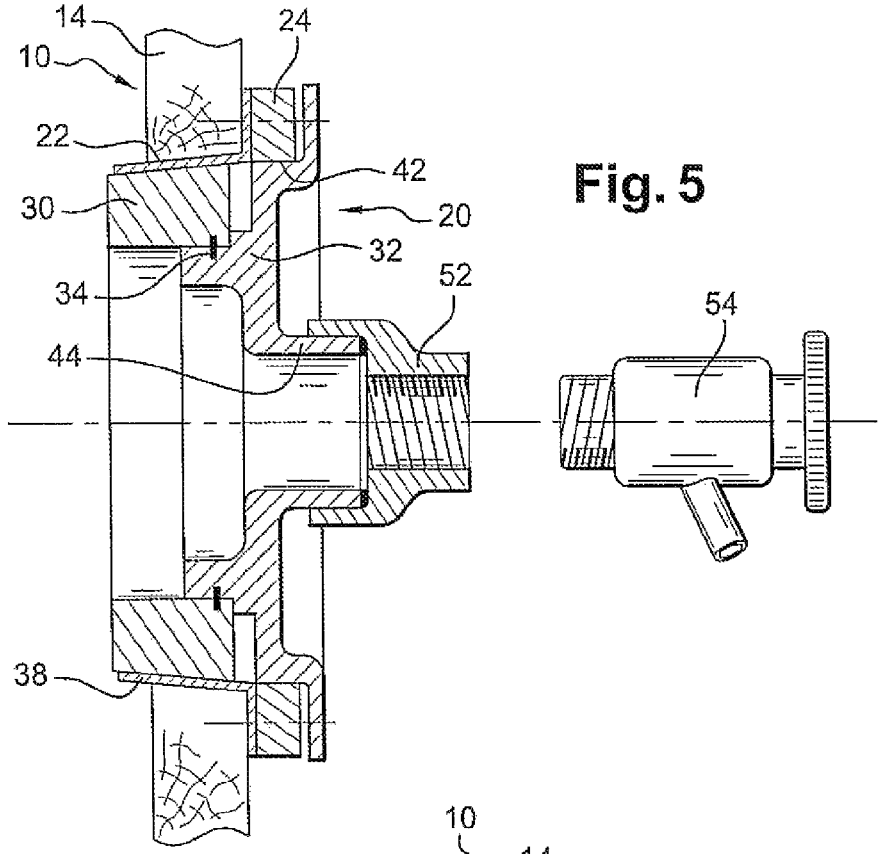
Figure 6:
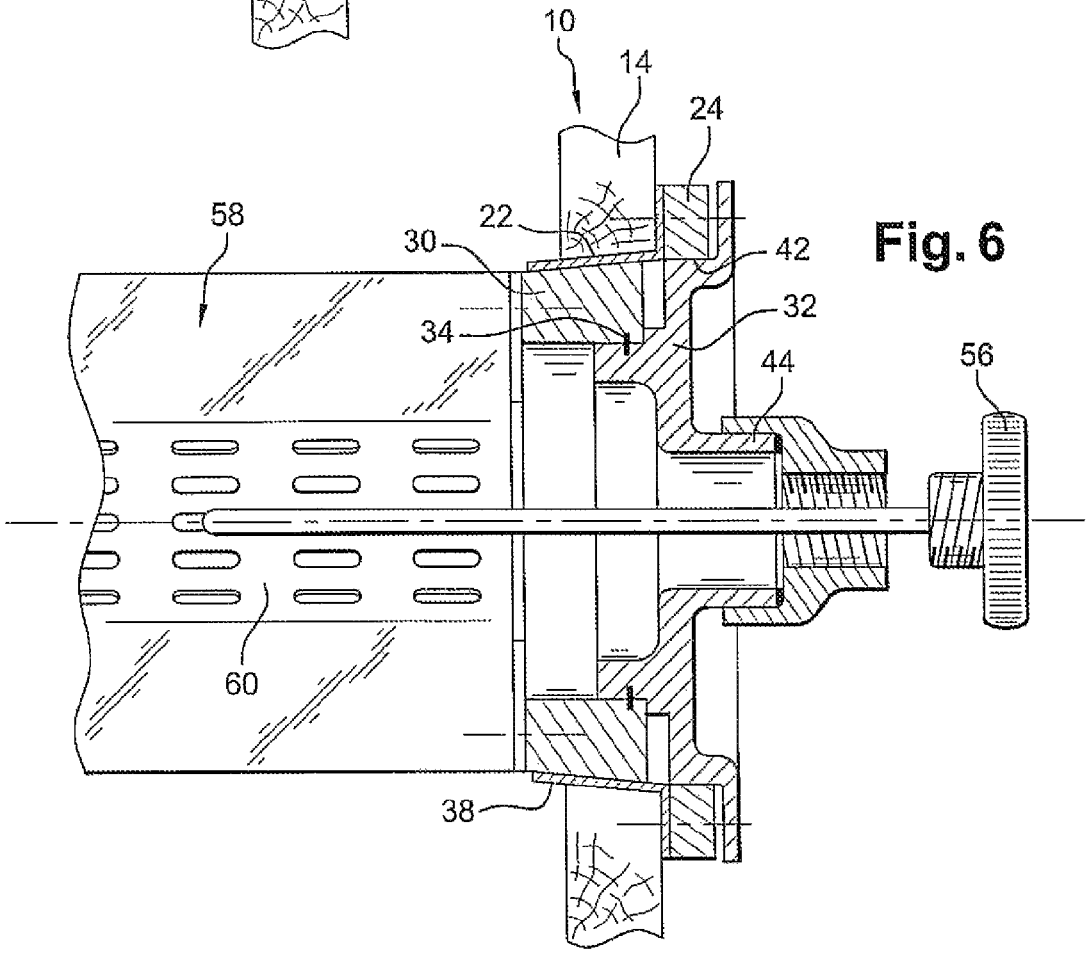
Figure 9:
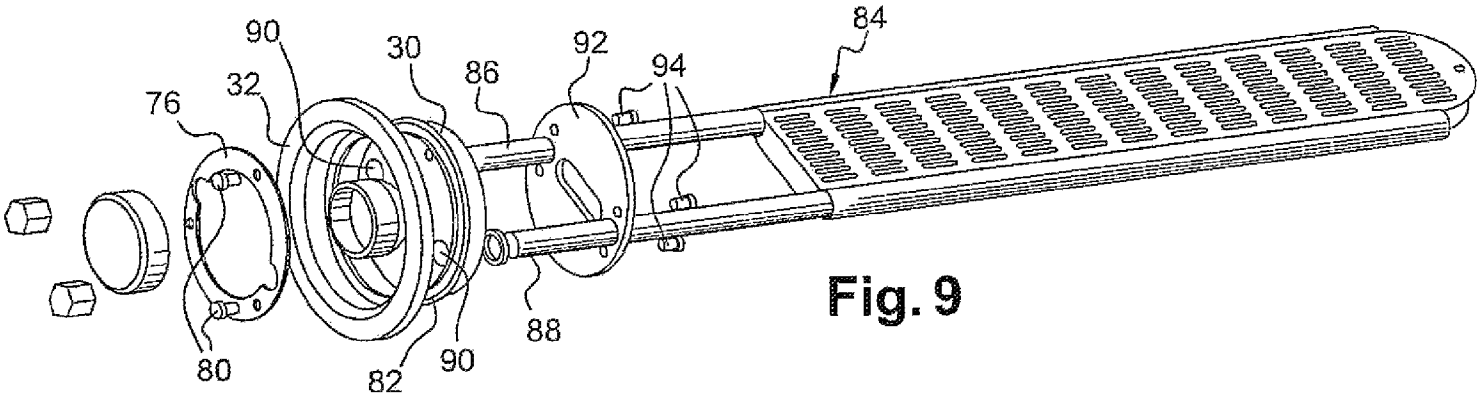
Figure 11:
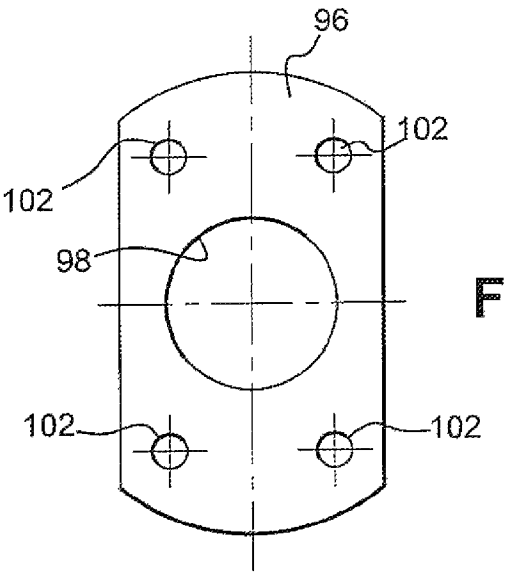
Figure 10:
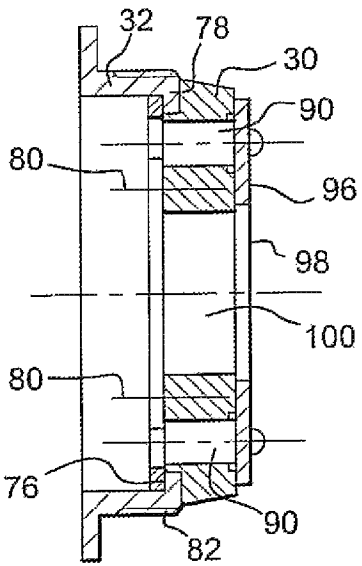

Other characteristics and advantages will become apparent from the following description of the invention given only by way of an example with respect to the accompanying drawings in which:

FIG. 1 is a longitudinal cutaway of a barrel equipped with a sealing device according to the invention, FIG. 2 is a cutaway of the fixed part, integral with the barrel, of the device of the invention, FIG. 3 is a cutaway of the sealing device according to the invention, FIG. 4 is a cutaway of the device of the invention provided with a bung, FIG. 5 is a cutaway of the device of the invention provided with an adapter to which a tap can be attached, FIG. 6 is a cutaway of the device onto which mixing means as well as an accessory such as a temperature probe are attached, FIG. 7 is an elevation view of the mixing means, FIG. 8 is a perspective view of an element that forms the mixing means, FIG. 9 is a perspective view that illustrates one variant of the device of the invention equipped with a heat exchanger, FIG. 10 is a cutaway of the variant of the device of the invention illustrated by FIG. 9, and FIG. 11 is an elevation view of a sealing plate that can be attached to the device.

In FIG. 1, a wooden barrel is shown at 10. In the known manner, this barrel comprises a side wall 12, in the form of a cask, comprised of staves, to the ends of which bottoms 14 are joined, said wall being belted by hoops 16. An orifice 18, sealed by a plug, can be provided at the level of the side wall. By way of indication, the diameter of this orifice varies from 3 to 5 cm so that it cannot be suitable for introduction of the grapes. The barrel is not presented in further detail because it is within the domain of one skilled in the art and does not constitute a critical element of the invention.

The barrel 10 comprises a sealing device 20 that is suited for barrel wine-making.

According to the invention, the barrel at the level of at least one bottom comprises an opening 22, preferably round and flared toward the outside of the barrel. This opening has a diameter of roughly ten centimeters. By way of example, it has a diameter of 120 mm. This opening must allow the passage of a conduit (shown in broken lines in FIG. 2) in which the grapes pass.

Advantageously, the opening 22 is off-center, for reasons that will be presented in detail below.

The sealing device 20 comprises, on the one hand, an attachment ring 24 that is located on the periphery of the opening 22 at the level of the outer surface of the bottom 14, connected to the bottom by any suitable means, especially by screws symbolized by axes 26, the inside diameter 28 of the ring being threaded, and, on the other hand, a sealing device comprising a first part 30 that can be wedged at the level of the opening 22 and a second part 32 that can be screwed onto the attachment ring 24, the second part as it is being screwed tending to increase the force of the pressure between the first part 30 and the opening 22.

Preferably, means of immobilization in translation, enabling rotary motion between the first part 30 and the second part 32, ensure the connection between said first and second parts. According to one preferred embodiment, a washer or a circlip 34 being placed, on the one hand, in a groove provided at the level of the first part 30 and, on the other hand, in a groove provided at the level of the second part 32 establishes the connection between said parts 30 and 32.

Advantageously, the second part 32 comprises a shoulder 36 that enhances the support against the first part 30.

The implementation of the sealing device in two parts makes it possible to obtain better tightness because it is ensured by the first part 30 that does not pivot relative to the opening when the sealing device is screwed onto the ring 24 that is connected to the barrel.

The washer 34 allows manipulation of only the combination alone, the first and second parts always being joined.

According to one embodiment, the outer surface of the first part 30 is slightly conical so as to work with the conical opening 22. This configuration makes it possible to obtain better tightness, the surface in contact between the first part 30 and the opening 22 being relatively large.

So as to improve tightness, the opening 22 can include a silicone coating. According to one embodiment, a flexible silicone jacket 38 is provided at the level of the opening 22. To keep it in position, said jacket 38 comprises on one of its two ends a collar 40 that can be arranged between the ring 24 and the outside wall of the bottom. In addition, the first part 30 can be made of silicone.

Advantageously, the first part 30 comes in the shape of a ring with an inside bore having a diameter that is adjusted to that of the shoulder 36 of the second part.

According to one embodiment, the second part comprises a shoulder 42 with threading that allows it to be screwed onto the ring 24.

According to another characteristic of the invention, the second part 32 comes in the shape of a flange with a central orifice that has been extended toward the outside by a conduit 44 that comprises means of integration with other elements such as a bung or an adapter, for example.

According to one embodiment, the conduit 44 at the level of the outside surface of its free end has threading 46 that allows other elements to be attached.

As illustrated in FIG. 4, a bung 48 can be screwed into the end of the conduit 44. A sealing washer 50 can be inserted between the bung 48 and the end of the conduit 44.

As illustrated in FIG. 5, an adapter 52 can be screwed into the end of the conduit 44, said adapter comprising a threaded diameter that is different from that of the conduit 44. This adapter can allow a tap 54 or a temperature probe 56 of standard dimensions to be attached.

The sealing device of the invention can be implemented using conventional industrial processes (molding, machining, etc.) and allows matching of different elements that are necessary during barrel wine-making, such as a bung to seal the barrel, a temperature probe, an electric resistance to heat and control fermentation, a cooling system, a glove finger or a tap to draw off the wine.

Moreover, the sealing device can be easily detached from the barrel and can clear the opening 22 to allow introduction of the grapes or withdrawal of the alcohol from grape skins.

Finally, at the end of fermentation, the sealing device can be replaced by a flange without an orifice that can be screwed onto the ring or onto the bottom of the barrel in place of the ring 24.

According to another characteristic of the invention, the mixing means can be connected to the sealing device, more exactly at the level of the free end of the first part 30 that can be located within the barrel. These mixing means comprise at least one spatula 58 located in the extension of the first part 30, oriented so as to mix the grapes during rotation of the barrel. This spatula 58 has dimensions suited to allowing its insertion into the barrel via the opening 22.

The fact of having an off-center opening 22 makes it possible to obtain better mixing.

Advantageously, the spatula 58 comprises a conduit 60 that can be arranged in the extension of the conduit 44 when the spatula 58 is attached to the first part 30, said conduit being equipped with at least one hole, and preferably a number of holes, allowing the interior and exterior of the conduit 60 to communicate. This conduit 60 makes it possible to install a temperature probe, an electric resistance, etc., inserted via the conduit 44.

According to one preferred embodiment illustrated by FIGS. 7 and 8, the mixing means comprise two plates 62, 62' shaped so as to have an omega-shaped section, with two essentially flat parts 64 forming a spatula, and one middle part 66, with a semicircular section, separating the flat parts 64. The two plates 62, 62' are bracketed against one another so as to form a spatula 58 with a middle conduit 60.

To establish the connection between the two plates, one of the lateral edges of each plate 62, 62' comprises a fold 68 so as to form a groove 70 that can accommodate the flat lateral edge of the other plate 62 or 62'. Thus, according to this embodiment, a spatula 58 is obtained from the two identical plates 62 and 62' that are arranged head to foot.

To ensure the attachment of the spatula 58 to the first part 30, the plates 62, 62' at the level of one of their ends comprise handles 72 obtained by folding, extending perpendicular to the plane of the spatula, at the level of each of which there is arranged an orifice 74 that allows passage of the body of an attachment screw that can be screwed into a thread provided at the level of the first part.

The invention makes it possible to obtain mixing means that can be easily withdrawn, allowing the same barrel to be kept for the phases of barrel fermentation and storage.

FIG. 9 shows another variant of the device of the invention provided with means for controlling the temperature. This device comprises a first part 30 that can be wedged at the level of the opening of the barrel and a second part 32 that can be screwed onto a stationary ring, connected at the level of said opening of the barrel.

To establish the connection between said parts 30 and 32, as illustrated in FIG. 10, there is a washer 76 that can be supported against a collar 78 arranged at the level of the second part 32, said washer 76 being able to be attached, for example by screws 80, to the first part 30. Advantageously, the first part comprises a clearance 82 that can accommodate the collar 78 in order that the washer 76 be flattened against the first part 30 and that there is play to allow rotation of the second part 32 relative to the first part 30.

In FIG. 9, the device of the invention comprises an exchanger 84 in the form of a tube, whose diameter and length are adjusted based on the desired exchanges. Optionally, the tube can have one or more coils to increase the exchange surface area.

The exchanger advantageously comprises a grid in order to mix the contents of the barrel.

The exchanger 84 comprises an inlet 86 and an outlet 88 that can be connected to any device suitable for providing a coolant.

The first part comprises two holes 90 allowing passage of the tube of the exchanger. Sealing means are provided to ensure tightness between the first part 30 and the exchanger at the level of the holes 90.

Preferably, the exchanger comprises a plate 92 that is integral with the exchanger 84 and that can be attached to the first part 30, for example by screws 94. When the sealing device does not include the exchanger, a plate 96 is provided to seal the holes 90. As illustrated in FIG. 11, this plate 96 includes an orifice 98 for working with the bore 100 of the first part 30. This plate 96 likewise comprises holes 102 for allowing passage of attachment elements to connect it to the first part 30.

Of course, the invention is obviously not limited to the embodiment that is shown and described above, but conversely encompasses all variants, especially with respect to forms, dimensions, and shapes of different components.

The invention claimed is:

1. A sealing device (20) for a barrel having a bottom (14) with an opening (22), the sealing device comprising:

a mixing means comprising a spatula (58) with an exchanger (84);

an attachment ring (24) locatable on a periphery of the opening (22); and a sealing unit (30, 32) comprised of a first part (30) and a second part (32), the first part comprising a hole (90) allowing passage of the exchanger (84), the second part comprising a central hole (32) formed with a first conduit (44) extending toward the outside of the barrel, the first conduit comprising means for integration means with another element, wherein, in use sealing the barrel, the attachment ring is located on the periphery of the opening (22), the second part (32) is screwed onto the attachment ring (24) compressing the first part (30), the first part (30) is wedged in the opening (22), the exchanger (84) is passed through the hole (90) of the first part, and the mixing means (58) is connected to the first part (30) and configured to mix grapes during rotation of the barrel.

2. A sealing device (20) for a barrel having a bottom (14) with an opening (22), the sealing device comprising:

an attachment ring (24) locatable on a periphery of the opening (22) of the bottom (14);

a sealing unit (30, 32) comprising a first part (30) and a second part (32), the second part (32) configured to be screwed onto the ring (24) and, when screwed onto the ring (24), to compress the first part (30), wedge the first part (30) in the opening (22), and seal the opening (22); and a mixing means comprising a spatula (58) connected to the first part (30) and configured to mix a contents of the barrel during rotation of the barrel.

3. The sealing device according to claim 2, wherein, the spatula (58) comprises an exchanger (84), the first part (30) comprises a hole (90) allowing passage of the exchanger (84), and a central hole of the second part (32) is extended toward the outside of the barrel by a first conduit (44) having means for integration (44) with another element.

4. The sealing device according to claim 3, wherein the spatula (58) further comprises a second conduit (60) arrangeable in the first conduit (44) of the second part (32) when the spatula (58) is attached to the first part (30).

5. The sealing device according to claim 2, wherein, the spatula (58) further comprises two plates (62,62'), each plate having an omega-shaped section, and the two plates (62, 62') are placed against one another defining said spatula (58).

6. The sealing device according to claim 5, wherein, each plate comprises flat lateral edges, and one of the lateral edges of each plate (62, 62') comprises a fold (68) defining a groove (70) that accommodates the flat lateral edge of the other plate (62, 62').

7. The sealing device according to claim 2, further comprising means (34) for i) enabling rotary motion between the first part (30) and the second part (32), and ii) establishing a connection between said first and second parts.

8. The sealing device according to claim 2 in combination with the barrel, wherein, the opening (22) of the barrel has a conical shape flared toward the outside of the barrel, and the first part (30) has a conical shape corresponding to the conical shape of the opening (22) of the barrel.

9. The sealing device according to claim 2, further comprising a silicone jacket (38) located between the periphery of the opening (22) and the first part (30), wherein the silicone jacket comprises a collar (40) located between the ring (24) and an outside wall of the bottom (14).

10. A barrel, comprising:

a bottom (14) with an opening (22);

an attachment ring (24) located on a periphery of the opening (22); and a sealing device (20) closing the opening (22), the sealing device (20) comprising a sealing unit (30, 32), the sealing unit (30, 32) comprising a first part (30) and a second part (32), the first part comprising a hole (90), the second part comprising a central hole (32) formed with a first conduit (44) extending toward the outside of the barrel, the first conduit comprising integration means (44), wherein, in an assembly condition sealing the barrel, the second part (32) is screwed onto the attachment ring (24) compressing the first part (30) with the first part (30) wedged in the opening (22).

11. The barrel according to claim 10, wherein the sealing device (20) comprises mixing means comprising a spatula (58) connected to the first part (30) and configured to mix grapes during rotation of the barrel.

12. The barrel according to claim 11, wherein the spatula (58) comprises a second conduit (60) arrangeable in the first conduit (44) of the second part (32) when the spatula (58) is attached to the first part (30).

13. The barrel according to claim 12, wherein, the spatula (58) further comprises two plates (62,62'), each plate having an omega-shaped section, and the two plates (62, 62') are placed against one another defining said spatula (58).

14. The barrel according to claim 13, wherein, each plate comprises flat lateral edges, and one of the lateral edges of each plate (62, 62') comprises a fold (68) defining a groove (70) that accommodates the flat lateral edge of the other plate (62, 62').

15. The barrel according to claim 10, wherein the sealing device (20) further comprises means (34) for i) enabling rotary motion between the first part (30) and the second part (32), and ii) establishing a connection between said first and second parts.

16. The barrel according to claim 10, wherein, the opening (22) of the barrel has a conical shape flared toward the outside of the barrel, and the first part (30) has a conical shape corresponding to the conical shape of the opening (22) of the barrel.

17. The barrel according to claim 10, wherein the sealing device (20) further comprises a silicone jacket (38) located between a periphery of the opening (22) and the first part (30), the silicone jacket comprising a collar (40) located between the ring (24) and the outside wall of the bottom (14).

* * * * *